US009380926B2

(12) United States Patent
Zhou et al.

(10) Patent No.: US 9,380,926 B2
(45) Date of Patent: Jul. 5, 2016

(54) TRAY SUPPORTING APPARATUS FOR DISHWASHER, CUTLERY TRAY ASSEMBLY AND DISHWASHER

(71) Applicant: FOSHAN SHUNDE MIDEA WASHING APPLIANCES MFG. CO., LTD., Beijiao (CN)

(72) Inventors: Haiguo Zhou, Beijiao (CN); Feng Gao, Beijiao (CN)

(73) Assignee: FOSHAN SHUNDE MIDEA WASHING APPLIANCES MFG. CO., LTD., Foshan (CN)

( * ) Notice: Subject to any disclaimer, the term of this patent is extended or adjusted under 35 U.S.C. 154(b) by 0 days.

(21) Appl. No.: 14/431,452

(22) PCT Filed: Sep. 5, 2013

(86) PCT No.: PCT/CN2013/083003

§ 371 (c)(1),
(2) Date: Mar. 26, 2015

(87) PCT Pub. No.: WO2014/048235

PCT Pub. Date: Apr. 3, 2014

(65) Prior Publication Data

US 2015/0245761 A1 Sep. 3, 2015

(30) Foreign Application Priority Data

Sep. 26, 2012 (CN) ..... 2012 1 0364953
May 3, 2013 (CN) ..... 2013 1 0160669

(51) Int. Cl.
*A47G 19/08* (2006.01)
*A47L 15/50* (2006.01)

(52) U.S. Cl.
CPC ..... *A47L 15/502* (2013.01)

(58) Field of Classification Search
CPC ... A47L 15/502; A47L 15/503; A47L 15/504; A47L 15/507
See application file for complete search history.

(56) References Cited

U.S. PATENT DOCUMENTS 3,306,694 A * 2/1967 Hauser ..... 312/311
3,466,109 A * 9/1969 Kaufman et al. ..... 312/228.1

(Continued)

FOREIGN PATENT DOCUMENTS

CN 201750518 2/2011
CN 202173374 3/2012

(Continued)

OTHER PUBLICATIONS

WIPO, International Search Report for PCT/CN2013/083003, Nov. 21, 2013.

*Primary Examiner* — Daniel J Troy
*Assistant Examiner* — Kimberley S Wright
(74) *Attorney, Agent, or Firm* — Hodgson Russ LLP

(57) ABSTRACT

Disclosed is a tray supporting apparatus for a dishwasher, the apparatus comprising: a support frame, two opposite sides of the support frame being respectively provided with a slide groove, and each slide groove comprising a first slideway a second slideway and the third slideway spaced apart from one another; a first and second bracket respectively adapted to support a tray, the first bracket and the second bracket being respectively provided on the support frame, wherein first ends of the first bracket and the second bracket are respectively slidably accommodated in the first slideway, a second end of the first bracket is slidably accommodated in the second slideway, and a second end of the second bracket is slidably accommodated in the third slideway.

20 Claims, 9 Drawing Sheets

(56) References Cited

U.S. PATENT DOCUMENTS

| | | | | |
|---|---|---|---|---|
| 3,556,625 | A * | 1/1971 | Kaufman | 312/301 |
| 3,560,069 | A * | 2/1971 | Dofpke | 312/351 |
| 3,594,058 | A * | 7/1971 | Kauffman | 312/298 |
| 3,726,581 | A * | 4/1973 | Doepke | 312/351 |
| 3,822,085 | A * | 7/1974 | Clark | 312/351 |
| 5,860,716 | A | 1/1999 | Good et al. | |
| 8,757,742 | B2 * | 6/2014 | McDaniel | 312/228.1 |
| 2005/0241682 | A1 * | 11/2005 | Jeong et al. | 134/56 D |
| 2006/0219271 | A1 * | 10/2006 | Feddema et al. | 134/56 D |
| 2006/0250058 | A1 * | 11/2006 | Stevens et al. | 312/311 |
| 2008/0072937 | A1 * | 3/2008 | Choi et al. | 134/137 |
| 2008/0110480 | A1 * | 5/2008 | Choi et al. | 134/135 |
| 2008/0156358 | A1 * | 7/2008 | Shin et al. | 134/137 |
| 2008/0156362 | A1 * | 7/2008 | Shin et al. | 134/201 |
| 2012/0139400 | A1 * | 6/2012 | Hofpeter et al. | 312/228.1 |
| 2014/0137905 | A1 * | 5/2014 | Shin et al. | 134/135 |
| 2014/0137906 | A1 * | 5/2014 | Shin et al. | 134/135 |
| 2014/0137907 | A1 * | 5/2014 | Shin et al. | 134/135 |
| 2015/0196189 | A1 * | 7/2015 | Shaffer et al. | 134/135 |
| 2015/0335225 | A1 * | 11/2015 | Seu | 134/135 |

FOREIGN PATENT DOCUMENTS

| | | | |
|---|---|---|---|
| CN | 202179515 | 4/2012 | |
| CN | 102469910 | 5/2012 | |
| EP | 2789286 | * 10/2014 | A47L 15/502 |
| JP | 2008036057 | 2/2008 | |

* cited by examiner

TRAY SUPPORTING APPARATUS FOR DISHWASHER, CUTLERY TRAY ASSEMBLY AND DISHWASHER

CROSS-REFERENCE TO RELATED APPLICATION

This application claims priority to and benefits of Chinese Patent Applications No. 201210364953.7, filed with the State Intellectual Property Office of P.R. China on Sep. 26, 2012 and No. 201310160669.2, filed with the State Intellectual Property Office of P.R. China on May 03, 2013. The entire contents of the above-identified applications are incorporated herein by reference.

FIELD

Embodiments of the present invention generally relate to a dishwasher technology field, and more particularly, to a tray supporting apparatus for a dishwasher, a cutlery tray assembly having the tray supporting apparatus and a dishwasher having the cutlery tray assembly.

BACKGROUND

A cutlery tray is provided inside a dishwasher to place various kinds of cutleries therein, such as a knife, a fork and a spoon. However, the cutlery tray of the conventional dishwasher has a fixed height and a position of the cutlery tray in a cleaning chamber of the dishwasher cannot be adjusted. Therefore, with the fixed height and position of the cutlery tray, the conventional dinner sets (such as standard knife, spoon and fork) can be easily placed in the cutlery tray. However, the cutlery with a bigger size may not be properly placed in the cutlery tray. Thus, most of the space in a top part of a liner in the dishwasher is occupied, and it is limited to place a cutlery with larger size (such as a goblet) in other space in the dishwasher and an inner space of the dishwasher cannot be used flexibly and fully according to actual requirements.

SUMMARY

Embodiments of the present invention seek to solve at least one of the problems existing in the related art to at least some extent.

Accordingly, an object of the present invention is to provide a tray supporting apparatus for a dishwasher, which is configured to place a tray, has a simple structure and is able to adjust a position of the tray flexibly.

Another object of the present invention is to provide a cutlery tray assembly including the above tray supporting apparatus.

Another object of the present invention is to provide a dishwasher including the above cutlery tray assembly.

Embodiments of a first broad aspect of the present invention provide a tray supporting apparatus, including: a supporting frame defining a sliding groove in each of two opposite sides of the supporting frame, each sliding groove having a first slideway, a second slideway and a third slideway spaced from one another; and a first bracket and a second bracket adapted to support a tray and disposed on the supporting frame respectively, wherein a first end of the first bracket and a first end of the second bracket are slidably received in the first slideway respectively, a second end of the first bracket is slidably received in the second slideway and a second end of the second bracket is slidably received in the third slideway.

With the tray supporting apparatus for the dishwasher according to embodiments of the present invention, by slidably supporting the front end and the rear end (i.e. the first and second ends) of the bracket in the sliding grooves of the supporting plate, the bracket can be driven to move, and a position and an angle of the tray disposed on the bracket can be adjusted, such that the position of the tray can be adjusted according to a size of a cutlery placed on the tray, thus making use of an inner space of the dishwasher flexibly and fully.

According to an embodiment of the present invention, the sliding groove further includes: a first vertical slideway and a second vertical slideway, the first vertical slideway is disposed at a left end of the first slideway and is communicated with the first slideway, and the second vertical slideway is disposed at a right end of the first slideway and is communicated with the first slideway.

In some embodiments, the first vertical slideway is extended downward from the left end of the first slideway and the second vertical slideway is extended from the right end of the first slideway.

In some embodiments, the second vertical slideway is disposed in a middle of a supporting plate, and the first slideway and the third slideway are separated by a top end of the second vertical slideway.

In some embodiments, a bottom of the second slideway is in flush with a bottom of the second vertical slideway.

The second slideway is disposed below the first slideway parallelly, and the third slideway is extended in a left and right direction and is aligned with the first slideway.

According to an embodiment of the present invention, the second slideway is adjacent to the second vertical slideway and is spaced from the first vertical slideway and the second vertical slideway respectively.

In some embodiments, a length of the second slideway is less than that of the first slideway.

According to another embodiment of the present invention, a length of the second slideway is equal to that of the first slideway, the second slideway is communicated with the first vertical slideway, and a separator is provided at an end of the second slideway close to a bottom of the second vertical slideway.

In some embodiments, the separator and the supporting frame are formed integrally.

According to an embodiment of the present invention, at least one end of the first slideway communicated with the first vertical slideway and the second vertical slideway is provided with a positioning protrusion, in which the positioning protrusion is configured to stop a movement of a corresponding end of the first or second bracket, the corresponding end of the first or second bracket may be released from a stop effect of the positioning protrusion when an external force is acted on the first or second bracket, and a section of the first slideway at which the positioning protrusion is provided is configured to allow the corresponding end of the first or second bracket pass through.

In some embodiments, the supporting frame is configured to have a substantial box-like structure, and each of a front frame and a rear frame of the supporting frame is formed by at least two horizontal supporting bars spaced from each other in an up and down direction.

According to an embodiment of the present invention, two supporting plates opposite to and spaced from each other are provided to the supporting frame, and each sliding groove is formed in a corresponding supporting plate respectively.

In some embodiments, the two supporting plates have a connection structure, and one of the two supporting plates is mounted at a front side of the supporting frame by the connection structure and the other of the two supporting plates is mounted at a rear side of the supporting frame by the connection structure.

In some embodiments, the connection structure includes: a plurality of hooks adapted to fit with the upmost horizontal supporting bar and disposed on an outer side of an upper part of the supporting plate; and a plurality of connection grooves adapted to fit with the downmost horizontal supporting bar and disposed on a bottom of the supporting plate.

In some embodiments, the plurality of hooks are distributed evenly on the supporting plate in the left and right direction and spaced from one another; and the plurality of connection grooves are distributed evenly on the supporting plate in the left and right direction and spaced from one another.

In some embodiments, the tray supporting apparatus further includes a plurality of sliding members slidably disposed in the sliding groove and at least connected with the front end and the rear end of the bracket respectively.

In some embodiments, the sliding member is configured as a pulley and rotatably connected with the front and rear ends of the bracket.

According to an embodiment of the present invention, the sliding groove is defined by the supporting bars at a corresponding side of the supporting frame.

In some embodiments, the first bracket and the second bracket are mounted on the supporting frame by a plurality of mounting hooks disposed at the front ends and the rear ends of the first bracket and the second bracket.

According to an embodiment of the present invention, the tray supporting apparatus further includes a roller assembly disposed on the supporting frame to move the supporting frame.

Embodiments of a second broad aspect of the present invention provide a cutlery tray assembly, including a tray supporting apparatus according to the embodiments of the first aspect of the present invention; and at least two trays configured to receive the cutlery and disposed on at least two brackets of the tray supporting apparatus.

In some embodiment, the tray comprises a snap structure, and the tray is disposed on the bracket by the snap structure.

Embodiments of a third aspect of the present invention provide a dishwasher, including a cutlery tray assembly according to the embodiments of the second aspect of the present invention.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the accompanying drawings, in which.

REFERENCE NUMERALS

Figure 1:
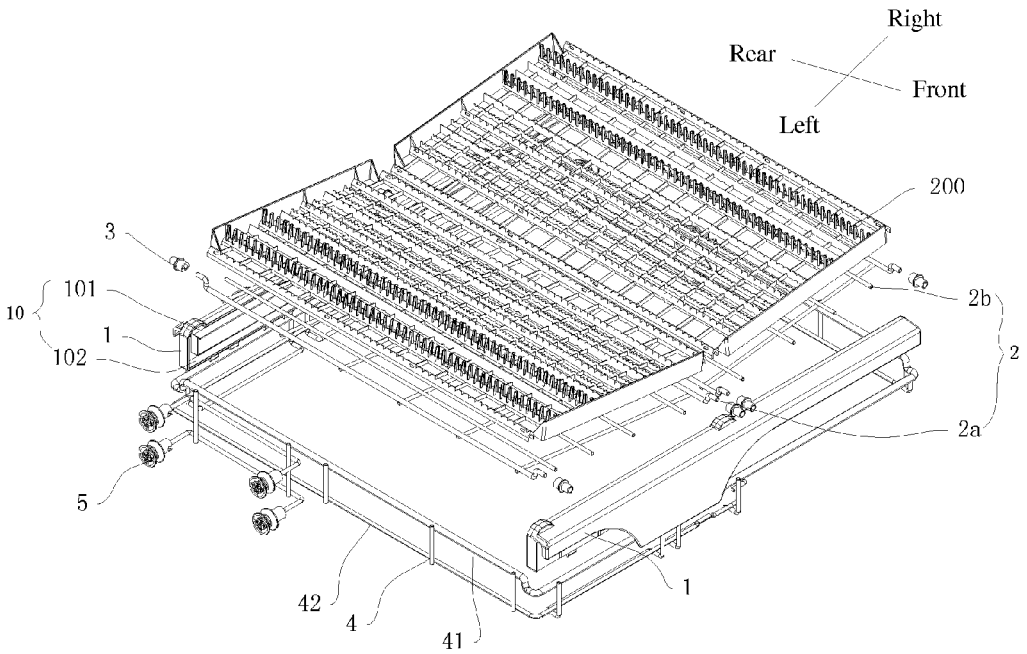
FIG. 1 is an exploded view of a tray supporting apparatus according to an embodiment of the present invention, in which a tray is disposed on the tray supporting apparatus.

100: tray supporting apparatus; 1: supporting frame; 110: supporting plate; 10: sliding groove;

101: first slideway; 102: second slideway; 103: third slideway;

104: first vertical slideway; 105: second vertical slideway;

11: separator; 12: positioning protrusion; 13: supporting bar;

2: bracket; 2*a*: first bracket; 2*b*: second bracket;

3: sliding member;

43: connecting structure; 431: hook; 432; connection groove;

5: rolling assembly;

200: tray; 200*a*: first tray; 200*b*: second tray;

300: snap structure

DETAILED DESCRIPTION

Reference will be made in detail to embodiments of the present invention. Embodiments of the present invention will be shown in drawings, in which the same or similar elements and the elements having same or similar functions are denoted by like reference numerals throughout the descriptions. The embodiments described herein according to drawings are explanatory and illustrative, not construed to limit the present invention.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom","inner", "outer", "clockwise", "anticlockwise" as well as derivative thereof (e.g., "horizontally", "downwardly", "upwardly", etc.) should be construed to refer to the orientation as then described or as shown in the drawings under discussion. These relative terms are for convenience of description and do not require that the present invention be constructed or operated in a particular orientation. In addition, terms such as "first" and "second" are used herein for purposes of description and are not intended to indicate or imply relative importance or significance. Thus, features limited by "first" and "second" are intended to indicate or imply including one or more than one these features. In the description of the present invention, "a plurality of" relates to two or more than two.

In the description of the present invention, unless specified or limited otherwise, it should be noted that, terms "mounted," "connected" and "coupled" may be understood broadly, such as permanent connection or detachable connection, electronic connection or mechanical connection, direct connection or indirect connection via intermediary, inner communication or interreaction between two elements. These having ordinary skills in the art should understand the specific meanings in the present invention according to specific situations.

A tray supporting apparatus 10 for a dishwasher according to an embodiment of the present invention will be described with reference to FIG. 1. In the following description, for example, the tray 200 is a cutlery tray 200 configured to place knives and forks, as shown in FIGS. 1 to 6*b*.

The tray supporting apparatus 100 according to embodiments of the present invention includes: a supporting frame 1 and two brackets adapted to support the tray 200, i.e., a first bracket 2*a* and a second bracket 2*b*.

Figure 2:
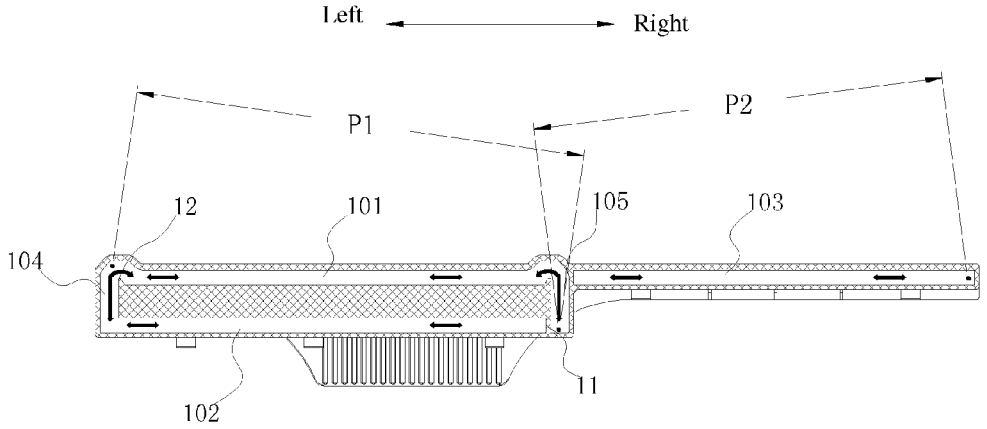
FIG. 2 is a schematic view showing a sliding groove in a supporting plate of a tray supporting apparatus according to an embodiment of the present invention.
Figure 3:
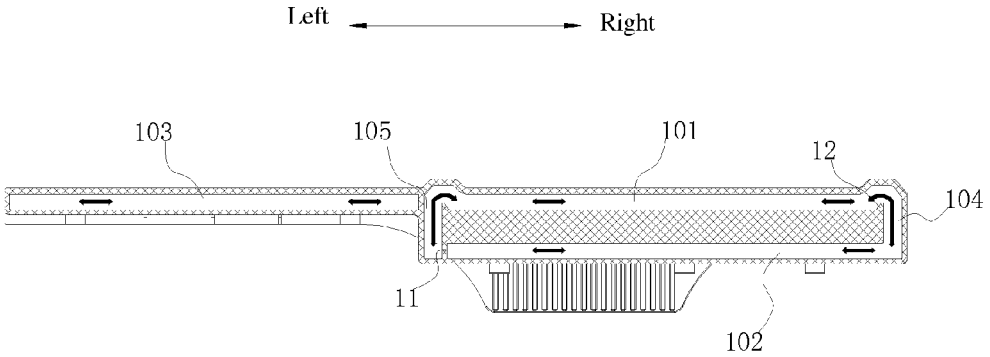
FIG. 3 is a schematic view showing a sliding groove in a supporting plate of a tray supporting apparatus according to another embodiment of the present invention.
Figure 9:
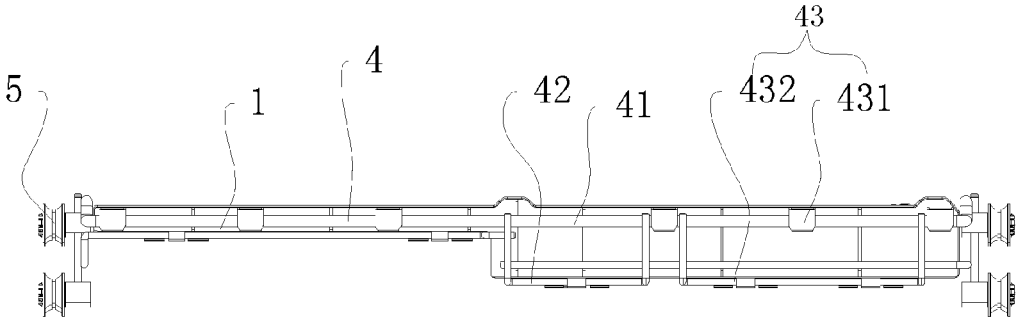
FIG. 9 is a rear view of a tray supporting apparatus according to an embodiment of the present invention.
Figure 10:
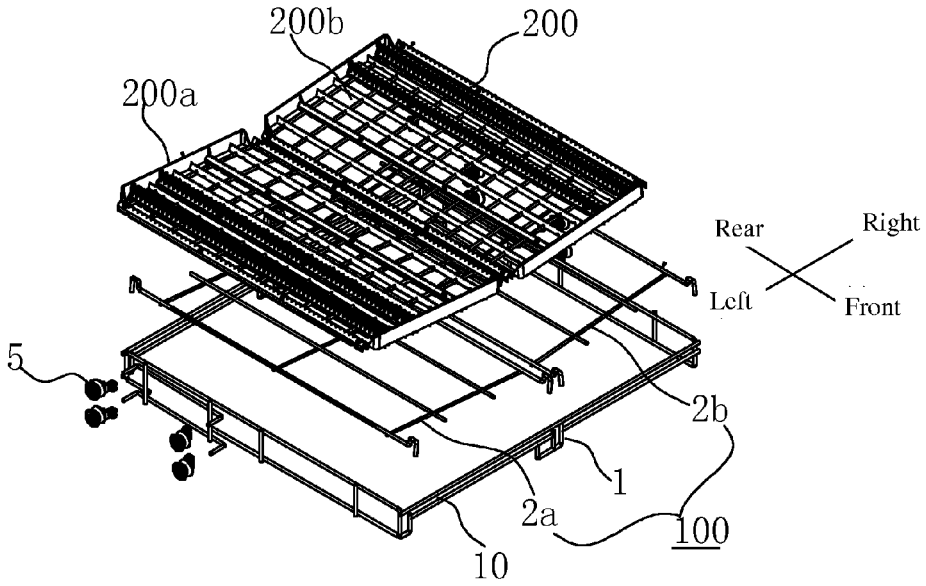
FIG. 10 is an exploded view of a cutlery tray assembly according to an embodiment of the present invention.

As shown in FIGS. 1, 2 and 10, a sliding groove 10 is formed in each of two opposite sides of the supporting frame 1, and each sliding groove 10 has a first slideway 101, a second slideway 102 and a third slideway 103 spaced from one another. In some embodiments as shown in FIGS. 1-19, the sliding groove 10 is formed in each of front and rear sides of the supporting frame 1, and the sliding grooves 10 in the front and rear sides have a same structure. Herein, the sliding groove 10 is formed in each of the front and rear sides of the support frame 10, which is taken as an example to illustrate the present invention. Certainly, it may be understood by those having ordinary skills in the related art that the sliding groove 10 may be formed in each of left and right sides of the supporting frame 1 according to actual requirements.

The first bracket 2*a* and the second bracket 2*b* are disposed on the supporting frame 1 respectively. Specially, front and rear ends of each bracket 2 are received in the sliding grooves 10 in the front and rear sides of the supporting frame 1, as shown in FIGS. 1, 10, 15 17 and 19. For describing the present invention conveniently, in following description and drawings, motion traces of the front ends of the first bracket 2*a* and the second bracket 2*b* within the sliding groove 10 in the front side of the supporting frame 1 are taken as an example to illustrate the present invention. It should be understood that motion traces of the rear ends of the first bracket 2*a* and the second bracket 2*b* within the sliding groove 10 in the rear side of the supporting frame 1 are the same with those of the front ends, which are omitted herein.

As shown in FIGS. 4*b*, 5*b*, 6*b*, 14, 16 and 18, a first end 21*a* (i.e., a left end in figures) of the first bracket 2*a* and the second end 21*b* (i.e., a right end in figures) of the second bracket 2*b* are slidably received in the first slideway 101, a second end 22*a* of the first bracket 2*a* is slidably received in the second slideway 102 and a second end 22*b* of the second bracket 2*b* is slidably received in the third slideway 103.

With the tray supporting apparatus for the dishwasher according to embodiments of the present invention, by slidably supporting the front ends and the rear ends of the first bracket 2*a* and the second bracket 2*b* in the sliding grooves of the supporting plate 1, the bracket 2 can be driven to move and a position and an angle of the tray 200 disposed on the bracket 2 can be adjusted, such that the position of the tray can be adjusted according to a size of the cutlery placed on the tray, thus making use of an inner space of the dishwasher flexibly and fully.

According to some embodiments of the present invention, the sliding groove 10 further includes a first vertical slideway 104 and a second vertical slideway 105. As shown in FIGS. 1*a*-6*b*, 14-19, the first vertical slideway 104 is disposed at a left end of the first slideway 101 and is communicated with the first slideway 101, and the second vertical slideway 105 is disposed at a right end of the first slideway 101 and is communicated with the first slideway 101. Therefore, the first end 21*a* of the first bracket 2*a* can slide within the first slideway 101 and the first vertical slideway 104, and the first end 21*b* of the second bracket 2*b* can slide in the first slideway 101 and the second vertical slideway 105, and thus positions and angles of the first bracket 2*a* and the second bracket 2*b* have many kinds of variations, which facilitates adjusting a position of the tray 200.

Alternatively, as shown in FIGS. 2, 3, 12 and 13, the first vertical slideway 104 is extended downward from the left end of the first slideway 101 and the second vertical slideway 105 is extended from the right end of the first slideway 101. In some embodiments, the second vertical groove 105 is formed in a middle of the sliding groove 10, i.e. between the first slideway 101 and the third slideway 103, and the first slideway 101 and the third slideway 103 are separated by a top end of the second vertical slideway 105. At this time, a width L1 of the first bracket 2*a* (a length of the first bracket 2*a* in a left and right direction, when the first bracket 2*a* is placed horizontally) and a width L2 of the second bracket 2*b* (a length of the second bracket 2*b* in a left and right direction, when the second bracket 2*b* is placed horizontally) are configured in such a manner that L1+L2<P1+P2, in which P1 is a distance from a top end of the first vertical slideway 104 to a bottom end of the second vertical slideway 105, and P2 is a distance from the bottom end of the second vertical slideway 105 to a right end of the third slideway 103, as shown in FIG. 2. In this way, it may be ensured that the first bracket 2*a* and the second bracket 2*b* can move in the sliding grooves 10 in different manners. Motion traces of ends of the first bracket 2*a* and the second bracket 2*b* are represented by arrows in FIGS. 2 and 3. In some embodiments, a bottom of the second slideway 102 is in flush with a bottom of the second vertical slideway 105.

Alternatively, the second slideway 102 is disposed below the first slideway 101 parallelly, and the third slideway 103 is extended in the left and right direction and is aligned with the first slideway 101. In other words, extension directions of the third slideway 103 and the first slideway 101 are in a same straight line, such as a horizontal line. Therefore, it is more convenient to adjust the positions and angles of corresponding ends of the first bracket 2*a* and the second bracket 2*b*. Certainly, the extension directions of the third slideway 103 and the first slideway 101 may be parallel with each other, but not in a same straight line. In some embodiments, the third slideway 103 is adjacent to and is spaced from the second vertical slideway 105, and an extension length of the third slideway 103 is substantially equal to that of the first slideway 101.

In an embodiment, the second slideway 102 is adjacent to the second vertical slideway 105 and is spaced from the first vertical slideway 104 and the second vertical slideway 105 respectively. In some embodiments, a length of the second slideway 102 is less than that of the first slideway 101, as shown in FIGS. 12-19.

In another embodiment of the present invention, the length of the second slideway 102 is equal to that of the first slideway 101, the second slideway 102 is communicated with the first vertical slideway 104 and is spaced from the second vertical slideway 105, as shown in FIGS. 4*a*-6*b*, in which a separator 11 is provided at an end of the second slideway 102 close to a bottom of the second vertical slideway 105. By disposing the separator 11, the end of the bracket 2 can move within the sliding groove in different manners, and thus the tray 200 may be arranged with different angles and in different positions.

For example, as shown in FIG. 2, the separator 11 is provided at the end of the second slideway 102 close to the bottom of the second vertical slideway 105. Therefore, the first slideway 101 is communicated with the second vertical slideway 105, and the second slideway 102 is spaced from the second vertical slideway 105, i.e., the ends of the first bracket 2*a* and the second bracket 2*b* cannot move from the second slideway 102 to the second vertical slideway 105 directly or from the second vertical slideway 105 to the second slideway 102 directly. In some embodiments, the separator 11 and the supporting frame 1 are formed integrally.

As shown in FIGS. 2, 3, 12 and 13, in a further embodiment of the present invention, each end of the first slideway 101 is provided with a positioning protrusion 12, which is configured to stop a movement of a corresponding end of the first or second bracket, and the corresponding end of the first or second bracket may be released from a stop effect of the positioning protrusion 12 when an external force is acted on the first or second bracket and may slide in the first vertical slideway 104 and the second vertical slideway 105. In other words, with the positioning protrusion 12, the first end 21*a* of the first bracket 2*a* and the first end 21*b* of the second bracket 2*b* may be restricted within the first slideway 101, instead of sliding into the first vertical slideway 104 and the second vertical slideway 105, thus implementing a positioning of the corresponding bracket so as to position the tray 200. However, the first end 21*a* of the first bracket 2*a* and the first end 21*b* of the second bracket 2*b* may be slidden into the first vertical slideway 104 or the second vertical slideway 105, when an external force is acted on the first or second bracket.

As shown in FIGS. 1-19, the supporting frame 1 is configured to have a substantial box-like structure, and each of the front frame and the rear frame of the supporting frame 1 is formed by at least two horizontal supporting bars spaced from each other in an up and down direction. Alternatively, the supporting bar 13 is a steel wire.

In an embodiment of the present invention, as shown in FIGS. 1-9, two supporting plates 110 opposite to and spaced from each other are provided to the supporting frame 1, and each sliding groove 10 is formed in a corresponding supporting plate 110 respectively.

In an embodiment of the present invention as shown in FIG. 1, the two supporting plates 110 are spaced from and parallel with each other in a front and rear direction. The sliding groove 10 is formed in each of opposite surfaces of the two supporting plates 110, and the sliding groove 10 includes the first slideway 101 and the second slideway 102 spaced from each other in the up and down direction, and a third slideway 103 in a same horizontal plane with the first slideway 101, in which the third slideway 103 is spaced from the first slideway 101, i.e., the first slideway 101 is not communicated with the third slideway 103.

Alternatively, two horizontal supporting bars are provided. The two supporting plates 110 have a connection structure 43, and one of the two supporting plates 110 is mounted at a front side of the supporting frame 1 by the connection structure 43 and the other of the two supporting plates 110 is mounted at a rear side of the supporting frame 1 by the connection structure 43.

Figure 8:
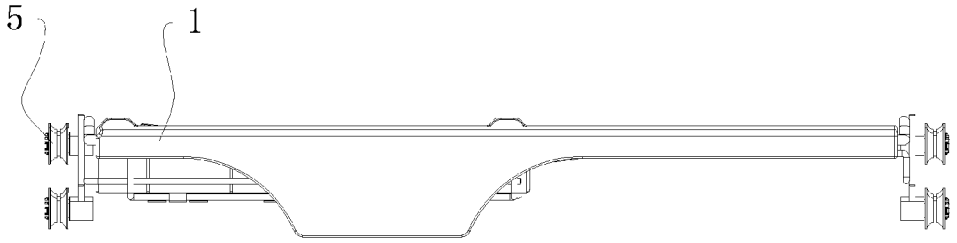
FIG. 8 is a front view of a tray supporting apparatus according to an embodiment of the present invention.

In an embodiment of the present invention, as shown in FIGS. 1, 8 and 9, the connection structure 43 includes: a plurality of hooks 431 and a plurality of connection grooves 432. The plurality of hooks 431 are adapted to fit with the upmost horizontal supporting bar 13 and is disposed on an outer side of an upper part of the supporting plate 110, and the plurality of connection grooves 432 are adapted to fit with the downmost horizontal supporting bar 13 and disposed on a bottom of the supporting plate 110. Alternatively, the plurality of hooks 431 are distributed evenly on the supporting plate 110 in the left and right direction and spaced from one another, and the plurality of connection grooves 432 are distributed evenly on the supporting plate 110 in the left and right direction and spaced from one another.

Figure 7:
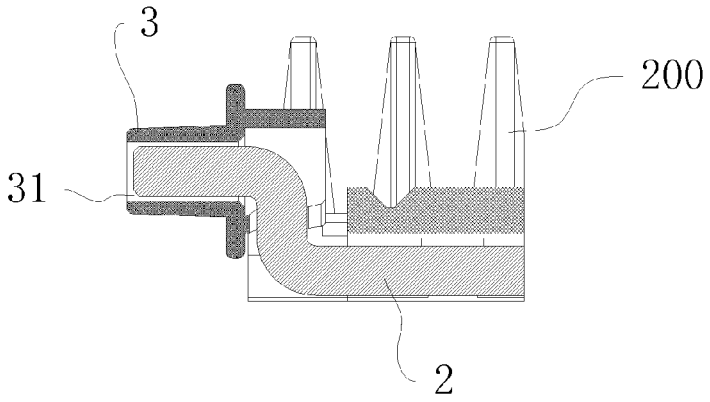
FIG. 7 is a schematic view showing a fitting relationship between a bracket and a sliding member of a tray supporting apparatus according to an embodiment of the present invention.

In a further embodiment of the present invention, the tray supporting apparatus 110 further includes a plurality of sliding members 3, and the plurality of sliding members 3 are slidably disposed in the sliding groove 10 and at least connected with the front end and the rear end of the bracket respectively, and thus the bracket 2 can be driven to slide between the two supporting plates 110. Alternatively, the sliding member 3 is configured as a pulley and rotatably connected with the corresponding end of the bracket 2, as shown in FIG. 7. In an embodiment of the present invention, a first end of the pulley is pre-mounted into the sliding groove 10 and a second end of the pulley defines an inserting hole 31, and a corresponding end of the bracket 2 is adapted to be snapped into the inserting hole 31. In some embodiments, a gap (not shown) is formed in a peripheral wall of the inserting hole 31 so as to form an elastic inserting structure, and thus the corresponding end of the bracket 2 is able to be rotated therein without separating from the inserting hole 31 when being inserted into the inserting hole 31.

Figure 11:
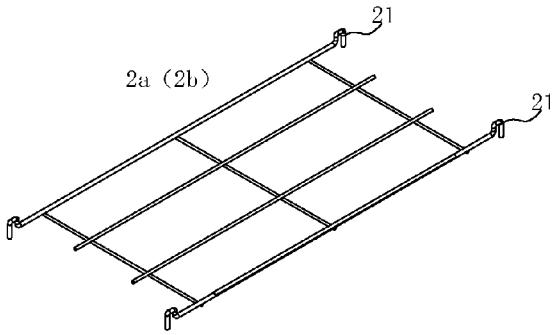
FIG. 11 is a schematic view showing a first or second bracket of a tray supporting apparatus according to an embodiment of the present invention.
Figure 12:
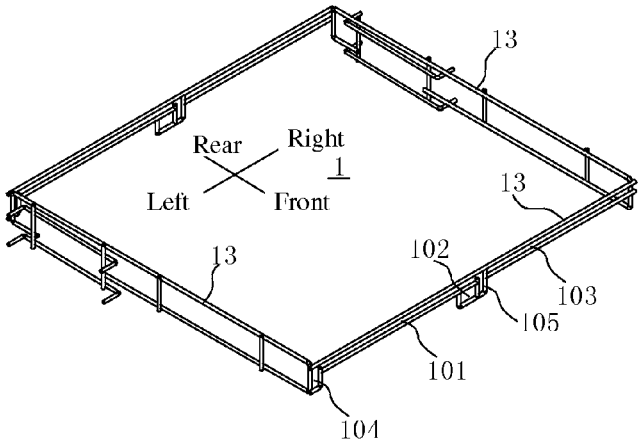
FIG. 12 is a schematic view showing a supporting frame of a tray supporting apparatus according to an embodiment of the present invention.
Figure 13:
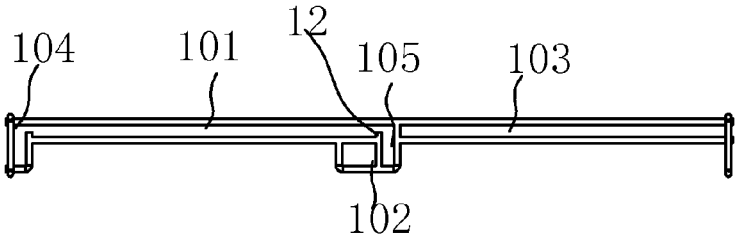
FIG. 13 is a front view of a supporting frame as shown in FIG. 12, in which a sliding groove is

In other embodiments of the present invention, as shown in FIGS. 10-19, the sliding groove 10 is defined by the supporting bar 13 at a corresponding side of the supporting frame 1 directly. Alternatively, as shown in FIGS. 10-12, the front ends and rear ends of the first bracket 2*a* and the second bracket 2*b* are provided with a plurality of mounting hooks 21, and the first bracket 2*a* and the second bracket 2*b* are mounted on the supporting frame 1 by the plurality of mounting hooks 21. Furthermore, the tray supporting apparatus 100 further includes a roller assembly 5, and the roller assembly 5 is disposed on the supporting frame 1 to move the supporting frame. As shown in FIGS. 1, 8, 9 and 10, the roller assembly 5 is disposed at each of the right side and the left side of the supporting frame 1, such that the supporting frame 1 can be driven to move within a sliding groove formed in an inner wall of a cleaning chamber in the dishwasher, and thus the tray supporting apparatus 100 can be put into or removed out from the cleaning chamber.

The first bracket 2*a* and the second bracket 2*b* of the tray supporting apparatus 100 according to embodiments of the present invention may have a plurality of position states, and some important positions thereof will be described in the following with reference to FIGS. 4*a*-6*b* and 14-19.

Figure 4A:
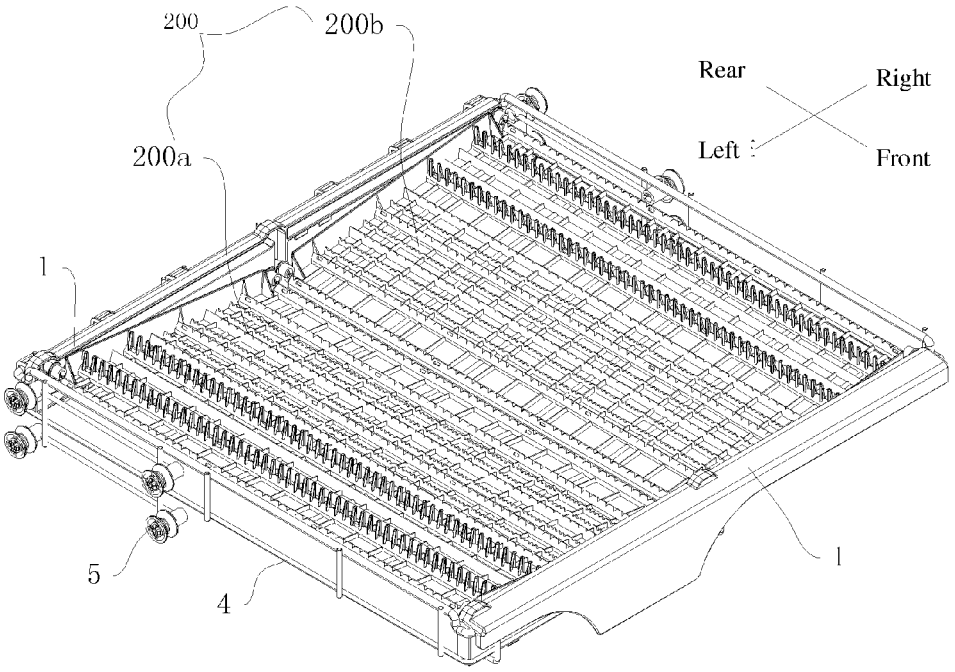
FIG. 4*a* is a schematic view showing a first position state of the tray supporting apparatus in FIG. 2.
Figure 4B:
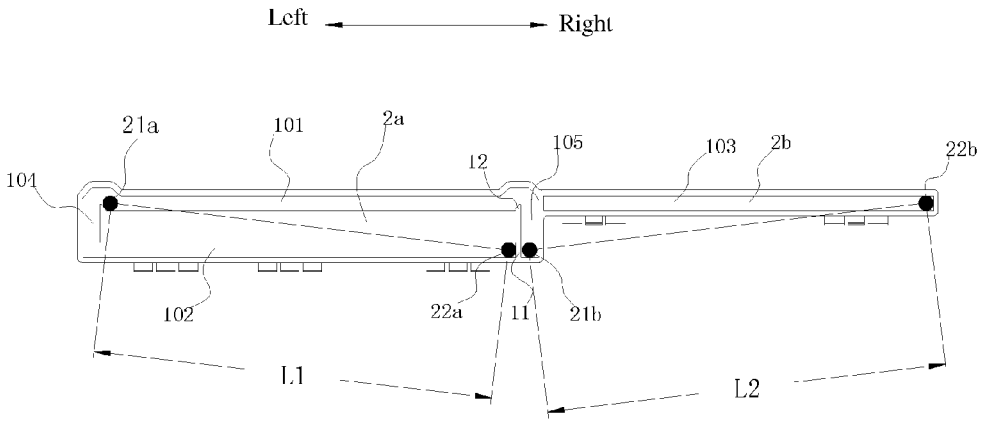
FIG. 4*b* is a schematic view showing positions of ends of first and second brackets in the sliding groove of the supporting plate when the tray supporting apparatus is in the first position state as shown in FIG. 4*a;*

In a first position state, as shown in FIG. 4*b*, the first bracket 2*a* and the second bracket 2*b* are configured to form a substantially V shape from a view of the front side of the tray supporting apparatus 100. Therefore, as shown in FIG. 4*a*, a first tray 200*a* on the first bracket 2*a* and a second tray 200*b* on the second bracket 2*b* are also configured to form a substantially V shape. In an embodiment of the present invention, the first end 21 a of the first bracket 2*a* is in the first slideway 101 and the second end 22*a* of the first bracket 2*a* is in the second slideway 102, the second end 22*b* of the second bracket 2*b* is in the third slideway 103 and the first end 21*b* of the second bracket 2*b* is in the second vertical slideway 105, in which the second end 22*a* of the first bracket 2*a* and the first end 21*b* of the second bracket 2*b* abut against the separator 11 respectively. Preferably, the first end 21 a of the first bracket 2*a* is stopped by the positioning protrusion 12 at the left end of the first slideway 101.

Figure 5A:
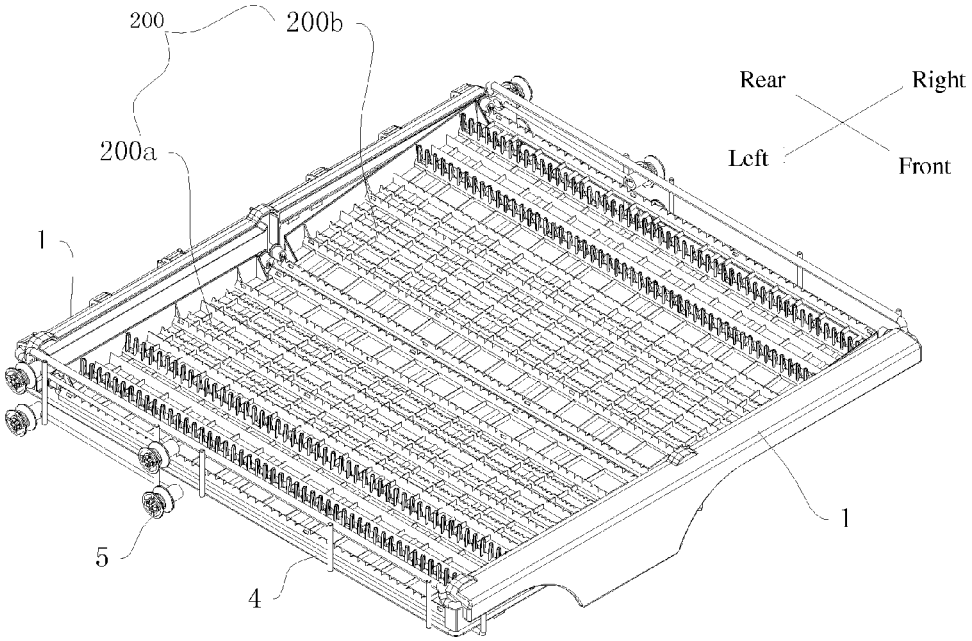
FIG. 5*a* is a schematic view showing a second position state of the tray supporting apparatus in FIG. 2.
Figure 5B:
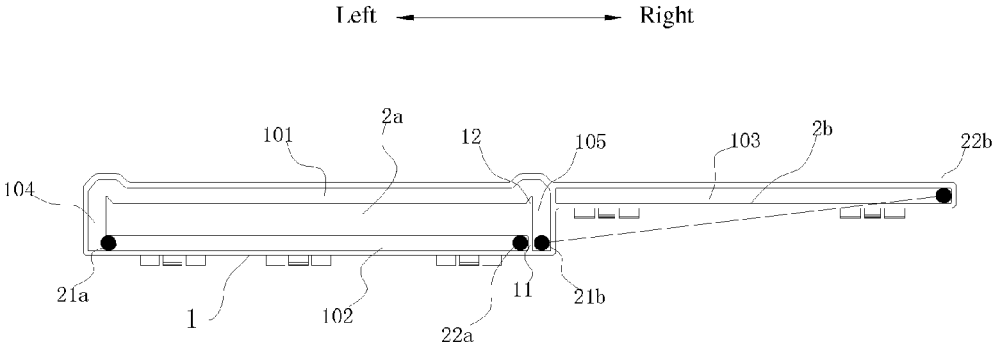
FIG. 5*b* is a schematic view showing positions of ends of first and second brackets in the sliding groove of the supporting plate when the tray supporting apparatus is in the second position state as shown in FIG. 5*a;*

In a second position state, as shown in FIG. 5*b*, from a view of the front side of the tray supporting apparatus 100, the first bracket 2*a* is arranged horizontally and the second bracket 2*b* is arranged obliquely. As shown in FIG. 5*a*, the first tray 200*a* on the first bracket 2*a* is arranged horizontally and the second tray 200*b* on the second bracket 2*b* is arranged obliquely as well. In an embodiment of the present invention, the first end 21*a* of the first bracket 2*a* is in the second slideway 102 and the second end 22*a* of the first bracket 2*a* is also in the second slideway 102, the first end 21*b* of the second bracket 2*b* is in the second vertical slideway 105 and the second end 22*b* of the second bracket 2*b* is in the third slideway 103, i.e., the second bracket 2*b* is inclined, in which the second end 22*a* of the first bracket 2*a* and the first end 21*b* of the second bracket 2*b* abut against the separator 11 respectively.

Figure 6A:
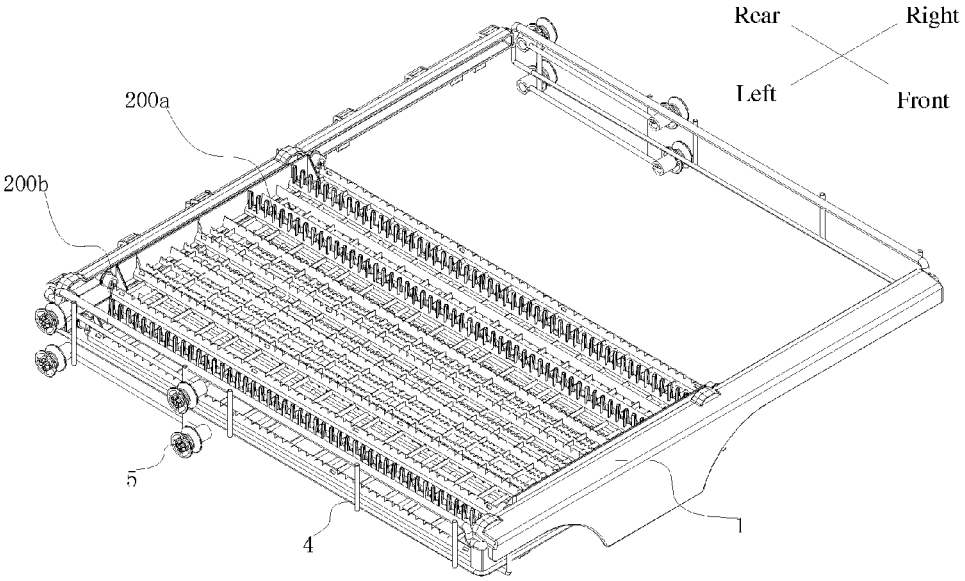
FIG. 6*a* is a schematic view showing a third position state of the tray supporting apparatus in FIG. 2.
Figure 6B:
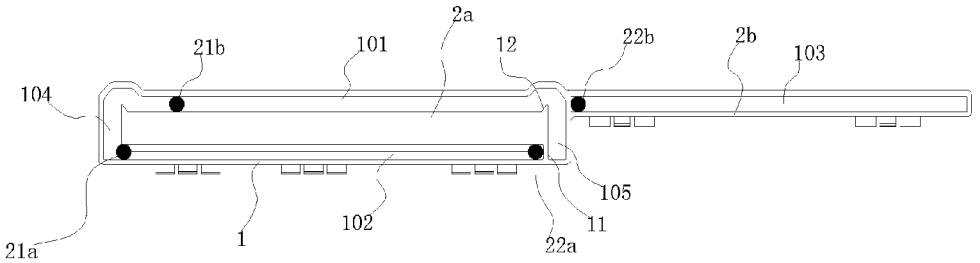
FIG. 6*b* is a schematic view showing positions of ends of first and second brackets in the sliding groove of the supporting plate when the tray supporting apparatus is in the third position state as shown in FIG. 6*a;*

In a third position state, as shown in FIG. 6*b*, the first bracket 2*a* and the second bracket 2*b* are parallel with each other and located at a left side of a base 4 from a view of the front side of the tray supporting apparatus 100. As shown in FIG. 6*a*, the first tray 200*a* on the first bracket 2*a* and the second tray 200*b* on the second bracket 2*b* are also parallel with each other and are located at the left side of the base 4. In an embodiment of the present invention, as shown in FIG. 6*b*, the first end 21*a* and the second end 22*a* of the first bracket 2*a* are in the second slideway 102 and the second end 22*a* of the first bracket 2*a* abuts against the separator 11, the first end 21*b* of the second bracket 2*b* is in the first slideway 101 and the second end 21*b* of the second bracket 2*b* is in the third slideway 103, i.e., the second bracket 2*b* is also arranged horizontally and above the first bracket 2*a*.

Figure 14:
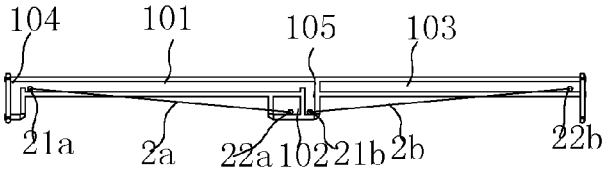
FIG. 14 is a front view of a tray supporting apparatus in a fourth position state according to an embodiment of the present invention.
Figure 15:
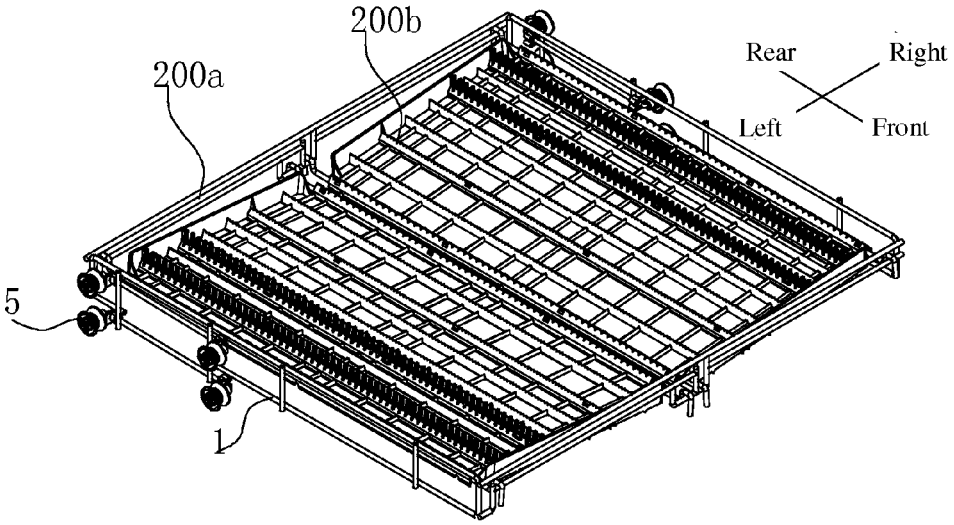
FIG. 15 is a perspective view of a cutlery tray assembly according to an embodiment of the present invention, in which a tray supporting apparatus is in a first position state.

In a fourth position state, as shown in FIG. 14, the first bracket 2*a* and the second bracket 2*b* are configured to form a substantially V shape from a view of the front side of the tray supporting apparatus 100. Therefore, as shown in FIG. 15, the first tray 200*a* on the first bracket 2*a* and the second tray 200*b* on the second bracket 2*b* are also configured to form a substantially V shape. In an embodiment of the present invention, the first end 21*a* (i.e., a left end in FIG. 14) of the first bracket 2*a* is in the first slideway 101 and is stopped by the positioning protrusion 12 at a left end of the first slideway 101, and the second end 22*a* of the first bracket 2*a* is in the second slideway 102. Meanwhile, the first end 21*b* of the second bracket 2*b* is at a bottom of the second vertical slideway 105 and the second end 22*b* of the second bracket 2*b* is at a right end of the third slideway 103.

Figure 16:
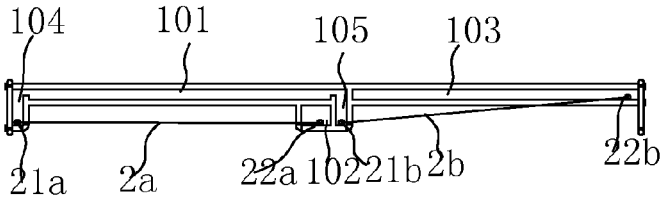
FIG. 16 is a front view of a tray supporting apparatus in a fifth position state according to an embodiment of the present invention.
Figure 17:
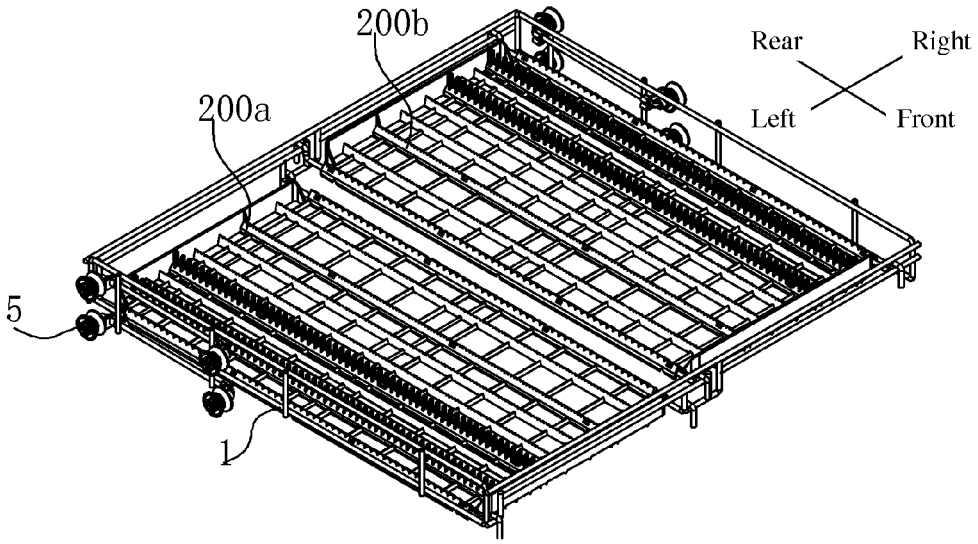
FIG. 17 is a perspective view of a cutlery tray assembly according to an embodiment of the present invention, in which a tray supporting apparatus is in a second position state.

In a fifth position state, as shown in FIG. 16, from a view of the front side of the tray supporting apparatus 100, the first bracket 2*a* is arranged horizontally and the second bracket 2*b* is arranged obliquely. As shown in FIG. 17, the first tray 200*a* on the first bracket 2*a* is arranged horizontally and the second tray 200*b* on the second bracket 2*b* is arranged obliquely. In an embodiment of the present invention, the first end 21*a* (i.e., the left end in FIG. 16) of the first bracket 2*a* is at a bottom of the first vertical slideway 104 and the second end 22*a* of the first bracket 2*a* is in the second slideway 102. Meanwhile, the first end 21*b* of the second bracket 2*b* is at the bottom of the second vertical slideway 105 and the second end 22*b* of the second bracket 2*b* is at the right end of the third slideway 103.

Figure 18:
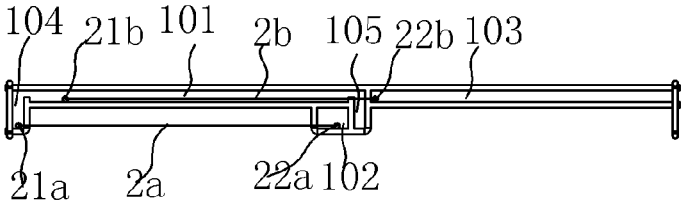
FIG. 18 is a front view of a tray supporting apparatus in a sixth position state according to an embodiment of the present invention.
Figure 19:
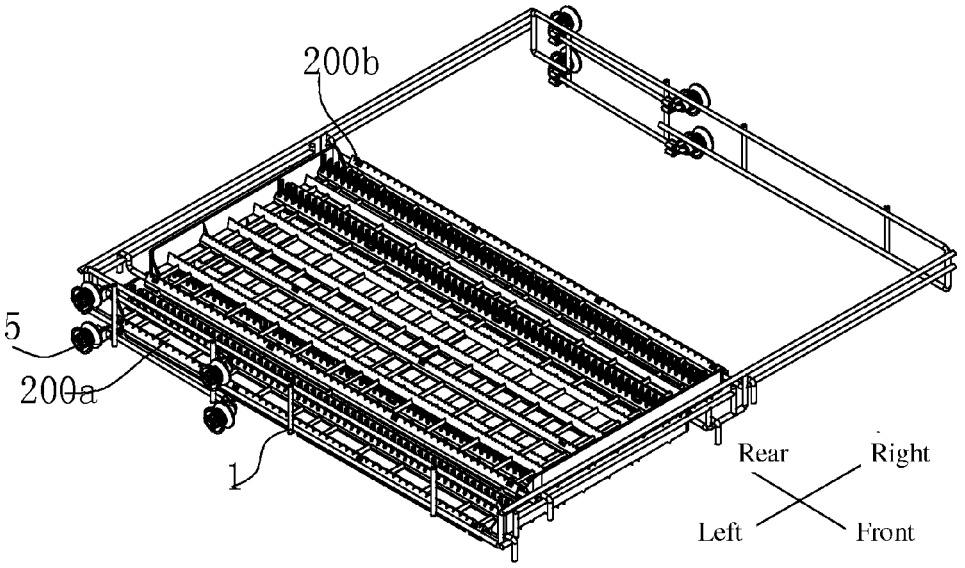
FIG. 19 is a perspective view of a cutlery tray assembly according to an embodiment of the present invention, in which a tray supporting apparatus is in a third position state.
Figure 20:
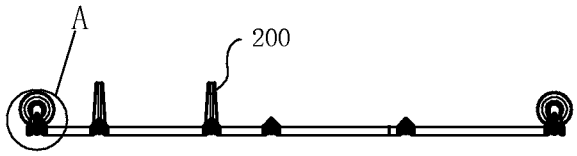
FIG. 20 is a schematic view showing a connection between a tray supporting apparatus and a tray in a cutlery tray assembly according to an embodiment of the present invention.

In a sixth position state, as shown in FIG. 18, the first bracket 2*a* and the second bracket 2*b* are parallel with each other and are located at a left side of the supporting frame 1 from a view of the front side of the tray supporting apparatus 100. As shown in FIG. 19, the first tray 200*a* on the first bracket 2*a* and the second tray 200*b* on the second bracket 2*b* are also parallel with each other and are located at the left side of the base 4. In an embodiment of the present invention, as shown in FIG. 19, the first end 21*a* (i.e., the left end in FIG. 19) of the first bracket 2*a* is at the bottom of the first vertical slideway 104 and the second end 22*a* of the first bracket 2*a* is in the second slideway 102. Meanwhile, the first end 21*b* of the second bracket 2*b* is in the first slideway 101 and is adjacent to the first vertical slideway 104, and the second end 21*b* of the second bracket 2*b* is at a left end of the third slideway 103. It may be understood by those having ordinary skills in the related art that, the above first and second bracket 2*a* and 2*b* may be exchangeable directly according to actual requirements and are not limited to the embodiments described above.

In conclusion, with the tray supporting apparatus according to embodiments of the present invention, by moving the ends of the bracket 2 within the sliding grooves to adjust the position of the bracket 2, the bracket 2 may have different position states, such that a user can adjust the position and angle of the tray placed on the bracket 2, and thus an inner space of the dishwasher can be divided reasonably, which improves a space utilization of the dishwasher and a flexibility of housing cutlery greatly.

Embodiments of a second aspect of the present invention provide a cutlery tray assembly for a dishwasher, including: a tray supporting apparatus 100 according to embodiments of the first aspect of the present invention and at least two trays 200 configured to receive the cutlery. The at least two trays 200 are disposed on at least two brackets 2 of the tray supporting apparatus 100.

Figure 21:
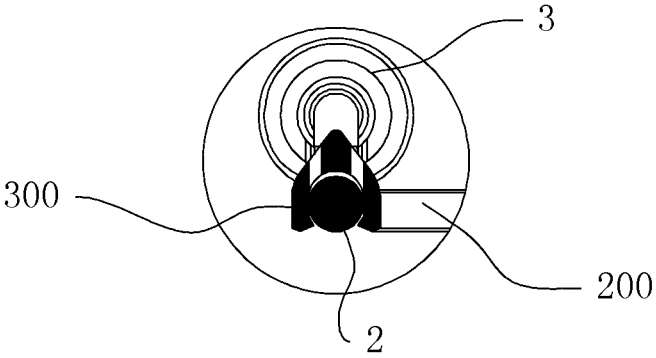
FIG. 21 is an enlarged schematic view of part A in FIG. 20.

The tray 200 includes a snap structure 300, and the snap structure 300 is disposed on the bracket 2, as shown in FIG. 21. In other words, the tray 200 is disposed on the bracket 2 by the snap structure 300.

Embodiments of a third aspect of the present invention provide a dishwasher, including a cutlery tray assembly according to embodiments of a second aspect of the present invention.

Other components (such as a cleaning device and a controlling device) of the dishwasher according to embodiments of the present invention and their operations are known by those having ordinary skills in the related art, which are omitted herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A tray supporting apparatus for a dishwasher, comprising:

a supporting frame defining a sliding groove in each of two opposite sides of the supporting frame, each sliding groove having a first slideway, a second slideway and a third slideway spaced from one another; and a first bracket and a second bracket adapted to support a tray and disposed on the supporting frame respectively, wherein a first end of the first bracket and a first end of the second bracket are slidably received in the first slideway respectively, a second end of the first bracket is slidably received in the second slideway and a second end of the second bracket is slidably received in the third slideway.

2. The device according to claim 1, wherein the sliding groove further comprises: a first vertical slideway and a second vertical slideway, the first vertical slideway is disposed at a left end of the first slideway and is communicated with the first slideway, and the second vertical slideway is disposed at a right end of the first slideway and is communicated with the first slideway.

3. The device according to claim 2, wherein the first vertical slideway is extended downward from the left end of the first slideway and the second vertical slideway is extended from the right end of the first slideway;

a bottom of the second slideway is in flush with a bottom of the second vertical slideway; and the second slideway is disposed below the first slideway parallelly, and the third slideway is extended in a left and right direction and is aligned with the first slideway.

4. The device according to claim 3, wherein the second slideway is adjacent to the second vertical slideway and is spaced from the first vertical slideway and the second vertical slideway respectively.

5. The device according to claim 4, wherein a length of the second slideway is less than that of the first slideway.

6. The device according to claim 3, wherein a length of the second slideway is equal to that of the first slideway, the second slideway is communicated with the first vertical slideway, and a separator is provided at an end of the second slideway close to a bottom of the second vertical slideway.

7. The device according to claim 6, wherein the separator and the supporting frame are formed integrally.

8. The device according to claim 2, wherein at least one end of the first slideway communicated with the first vertical slideway and the second vertical slideway is provided with a positioning protrusion, wherein the positioning protrusion is configured to stop a movement of a corresponding end of the first or second bracket, the corresponding end of the first or second bracket may be released from a stop effect of the positioning protrusion when an external force is acted on the first or second bracket, and a section of the first slideway at which the positioning protrusion is provided is configured to allow the corresponding end of the first or second bracket pass through.

9. The device according to claim 2, wherein the supporting frame is configured to have a substantial box-like structure, and each of a front frame and a rear frame of the supporting frame is formed by at least two horizontal supporting bars spaced from each other in an up and down direction.

10. The device according to claim 9, wherein two supporting plates opposite to and spaced from each other are provided to the supporting frame, and each sliding groove is formed in a corresponding supporting plate respectively, and the two supporting plates have a connection structure, and one of the two supporting plates is mounted at a front side of the supporting frame by the connection structure and the other of the two supporting plates is mounted at a rear side of the supporting frame by the connection structure.

11. The device according to claim 10, wherein the connection structure comprises:

a plurality of hooks adapted to fit with the upmost horizontal supporting bar and disposed on an outer side of an upper part of the supporting plate; and a plurality of connection grooves adapted to fit with the downmost horizontal supporting bar and disposed on a bottom of the supporting plate, wherein the plurality of hooks are distributed evenly on the supporting plate in the left and right direction and spaced from one another; and the plurality of connection grooves are distributed evenly on the supporting plate in the left and right direction and spaced from one another.

12. The device according to claim 10, further comprising:

a plurality of sliding members slidably disposed in the sliding groove and at least connected with the front end and the rear end of the bracket respectively.

13. The device according to claim 12, wherein the sliding member is configured as a pulley and rotatably connected with the front and rear ends of the bracket.

14. The device according to claim 9, wherein the sliding groove is defined by the supporting bars at a corresponding side of the supporting frame.

15. The device according to claim 14, wherein the first bracket and the second bracket are mounted on the supporting frame by a plurality of mounting hooks disposed at the front ends and the rear ends of the first bracket and the second bracket.

16. The device according to claim 8, further comprising:

a roller assembly disposed on the supporting frame to move the supporting frame.

17. The device according to claim 10, wherein the second vertical slideway is disposed in a middle of a supporting plate, and the first slideway and the third slideway are separated by a top end of the second vertical slideway.

18. A cutlery tray assembly for a dishwasher, comprising:

a tray supporting apparatus, comprising:

a supporting frame defining a sliding groove in each of two opposite sides of the supporting frame, each sliding groove having a first slideway, a second slideway and a third slideway spaced from one another; and a first bracket and a second bracket adapted to support a tray and disposed on the supporting frame respectively, wherein a first end of the first bracket and a first end of the second bracket are slidably received in the first slideway respectively, a second end of the first bracket is slidably received in the second slideway and a second end of the second bracket is slidably received in the third slideway; and at least two trays configured to receive knife and fork and disposed on at least two brackets of the tray supporting apparatus.

19. The assembly according to claim 18, wherein the tray comprises a snap structure, and the tray is disposed on the bracket by the snap structure.

20. A dishwasher system, comprising;

a dishwasher and a cutlery tray assembly, wherein, the cutlery tray assembly comprises:

a tray supporting apparatus comprising:

a supporting frame defining a sliding groove in each of two opposite sides of the supporting frame, each sliding groove having a first slideway, a second slideway and a third slideway spaced from one another; and a first bracket and a second bracket adapted to support a tray and disposed on the supporting frame respectively, wherein a first end of the first bracket and a first end of the second bracket are slidably received in the first slideway respectively, a second end of the first bracket is slidably received in the second slideway and a second end of the second bracket is slidably received in the third slideway; and at least two trays configured to receive knife and fork and disposed on at least two brackets of the tray supporting apparatus.

* * * * *